United States Patent [19]

Parry

[11] 4,355,220

[45] Oct. 19, 1982

[54] ELECTRICAL SWITCHGEAR OF THE ROTATING ARC, DOUBLE-BREAK TYPE

[75] Inventor: John Parry, Blackwood, Wales

[73] Assignee: South Wales Switchgear Limited, Blackwood, Wales

[21] Appl. No.: 151,581

[22] Filed: May 20, 1980

[30] Foreign Application Priority Data

May 25, 1979 [GB] United Kingdom ..... 7918466

[51] Int. Cl.[3] ..... H01H 33/18

[52] U.S. Cl. ..... 200/147 R; 200/148 R

[58] Field of Search ..... 200/147 R, 147 A, 144 B

[56] References Cited

U.S. PATENT DOCUMENTS

| | | | |
|---|---|---|---|
| 2,798,922 | 7/1957 | Lingal | 200/148 G |
| 3,014,109 | 12/1961 | Burger | 200/147 A |
| 3,361,887 | 1/1968 | Bachofen | 200/144 B |
| 3,372,259 | 3/1968 | Porter | 200/144 B |
| 3,542,985 | 11/1970 | Madsen | 200/147 R |

FOREIGN PATENT DOCUMENTS

| | | | |
|---|---|---|---|
| 1640955 | 12/1970 | Fed. Rep. of Germany | 200/147 R |
| 719593 | 11/1931 | France | 200/147 A |
| 165961 | 12/1933 | Switzerland | 200/147 R |

*Primary Examiner*—Robert S. Macon

*Attorney, Agent, or Firm*—Charles E. Brown

[57] ABSTRACT

Electrical switchgear comprises a pair of contact arms which, in a contacts closed position, engage the ends of a main contact bar. Upon movement of the electrical switchgear towards a contacts open position, the contact bar disengages from the contact arms and an arc is drawn between each contact arm and a respective arcing electrode. A common field coil has its ends electrically connected to the arcing electrodes respectively, such that the arcing current flows through the field coil to create a magnetic field which causes the arcs to rotate and become extinguished. An insulating barrier separates the electrodes to prevent the arc from being transferred directly across the contact arms.

20 Claims, 13 Drawing Figures

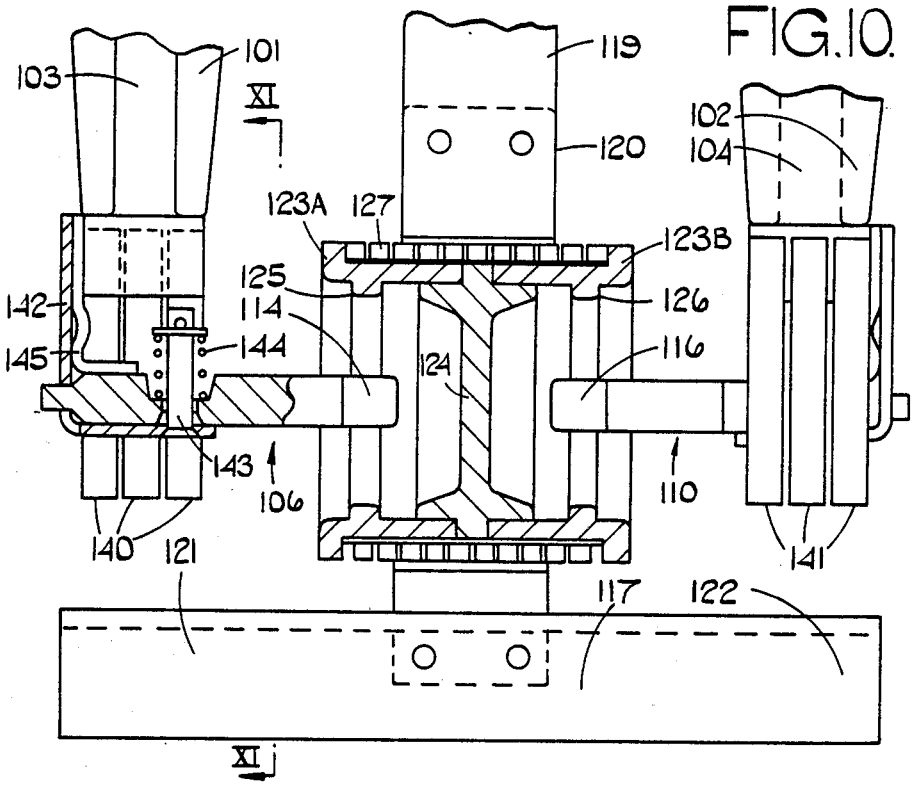
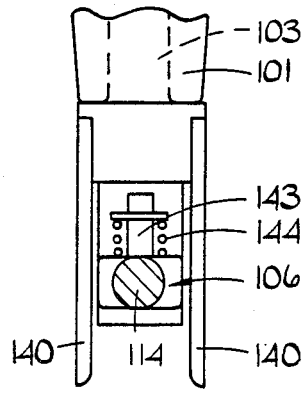
FIG.11.
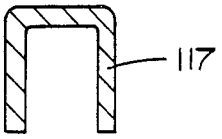

ELECTRICAL SWITCHGEAR OF THE ROTATING ARC, DOUBLE-BREAK TYPE

This invention relates to electrical switchgear, the term "switchgear" being used to embrace circuit breakers and other electrical switches.

In some known circuit breakers an arc rotation technique is employed to extinguish the arc drawn between contacts on opening the circuit breaker, the arc current being caused to pass through a field coil to generate a magnetic field which makes the arc rotate and become extinguished. This technique is particularly useful in circuit breakers which utilize the highly insulating gas sulphur hexafluoride.

It is also well known to employ double break construction in switchgear by which a current is interrupted by two breaks in series instead of a single break. Double break construction is recognised as possessing advantages over single break construction particularly with regard to security of interruption but has the disadvantage that there are twice as many arcs to extinguish as in single break construction.

If an arc rotation technique is combined with a double break construction, one is faced with the problem of either having to employ double the number of field coils or finding some way of sharing field coils without introducing the danger of "tracking" across the shared structure taking place. It has to be borne in mind that insulating surfaces in circuit breakers may become contaminated in time, for example because of the presence of metal vapours in the arcs.

It is an object of the present invention to obviate or mitigate this difficulty.

According to the present invention, there is provided electrical switchgear comprising a contact set composed of a pair of first contact means and second contact means which are relatively movable between a closed position in which the second contact means is engaged with both of the first contact means and an open position in which the second contact means is disengaged from both of the first contact means, and a common field coil located between said pair of first contact means, the first contact means being arranged to arc to respective ends of the field coil when the contacts are moved from their closed position to their open position, such that an arcing current flows through the field coil to create a magnetic field which causes the said arcs to rotate and become extinguished.

It is also a well-known technique to provide an arcing contact to which an arc created on opening main or intermediate contacts transfers itself as one of the main or intermediate contacts moves near to the arcing contact. Since this technique relies on the arc behaving in a predetermined manner, the transfer of the arc must to some extent at least be regarded as not entirely certain.

In a preferred example of the present invention, a pair of arcing electrodes are provided to which the first contact means respectively arc when the contacts are moved from their closed position to their open position, the arcing electrodes being connected to the ends of the field coil, respectively. The arcing electrodes can be tubular and the field coil can be disposed substantially co-axially therewith, and each first contact means can have a part which is arranged to engage the respective arcing electrode before and for some time after the first and second contact means disengage and which is arranged to move to a position substantially on the axis of the arcing electrode when the contacts move to their open position. This type of construction forms the subject of our co-pending U.K. patent application no. 7,918,466 of even date.

Embodiments of the present invention will now be described, by way of example, with reference to the accompanying drawings, in which:

FIGS. 9 and 10 are similar views to FIG. 8, but showing the contacts respectively partially open and fully open;

FIG. 11 is a section on the line XI—XI in FIG. 10;

Figure 1:
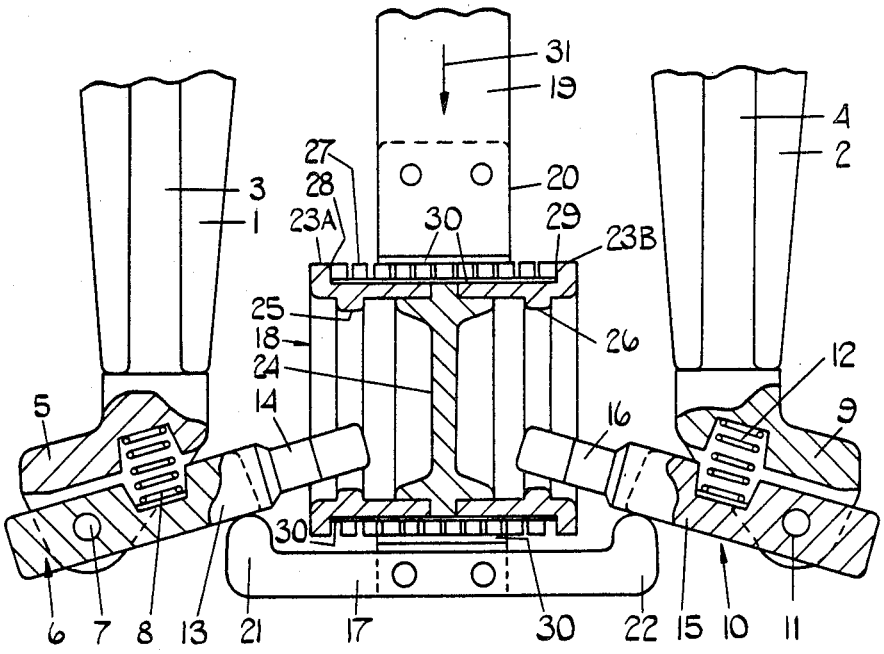
FIG. 1 is a schematic side view of part of a first embodiment of electrical switchgear according to the present invention, showing contacts of the switchgear in a closed position.

Referring first to FIGS. 1 to 6 the contacts and associated parts of a circuit breaker employing sulphur hexafluoride as an insulating gas are shown. The circuit breaker comprises a pair of electrically insulating terminal bushings 1 and 2 through which respective conductors 3 and 4 pass. A mounting 5 is provided at one end of the conductor 3 and pivotally supports a contact arm 6 by means of a pivot pin 7, a helical contact spring 8 in compression being provided to act between the mounting 5 and the contact arm 6. A similar assembly of a mounting 9, a contact arm 10, a pivot pin 11 and a spring 12 are provided at the end of the conductor 4. The contact arm 6 is composed of a main body portion 13 of rectangular cross-section and an end portion 14 of lesser and circular cross-section. The contact arm 10 is similarly composed of a main body portion 15 and an end portion 16. The end portions 14 and 16 can be provided with arc-resistant material.

The circuit breaker also comprises a main contact bar 17 and a field coil assembly 18 which are mounted on an end of reciprocable insulating shaft 19 by means of a support member 20. The main contact bar 17 has ends 21 and 22 which engage the main body portions of the contact arms 6 and 10 respectively when the circuit breaker is in a closed position, as shown in FIG. 1. The springs 8 and 12 act to urge their associated contact arms into engagement with the main contact bar 17 and a current path thus exists from the conductor 3 to the conductor 4 by way of the mounting 5, the contact arm 6, the main contact bar 17, the contact arm 10 and the mounting 9.

The field coil assembly 18 comprises a pair of co-axially disposed tubular arcing electrodes 23A and 23B which are separated by a central, transversely extending insulating barrier 24. The electrodes 23A and 23B are provided with respective internal annular projections or arc runners 25 and 26, which can be surfaced with arc-resistant material. A helical field coil 27 surrounds the external surfaces of the arcing electrodes 23A and 23B. One end of the coil 27 is connected to electrode 23A at a point 28, the other end of the coil being connected to electrode 23B at a point 29. Otherwise, the coil 27 is electrically insulated from the arcing electrodes by means of insulation 30. In the closed position of the circuit breaker, the end portions 14 and 16 of the contact arms 6 and 10 lie within the field coil assembly 18, and are adjacent to but spaced from the arc runners 25 and 26 of the electrodes 23A and 23B, respectively.

Figure 2:
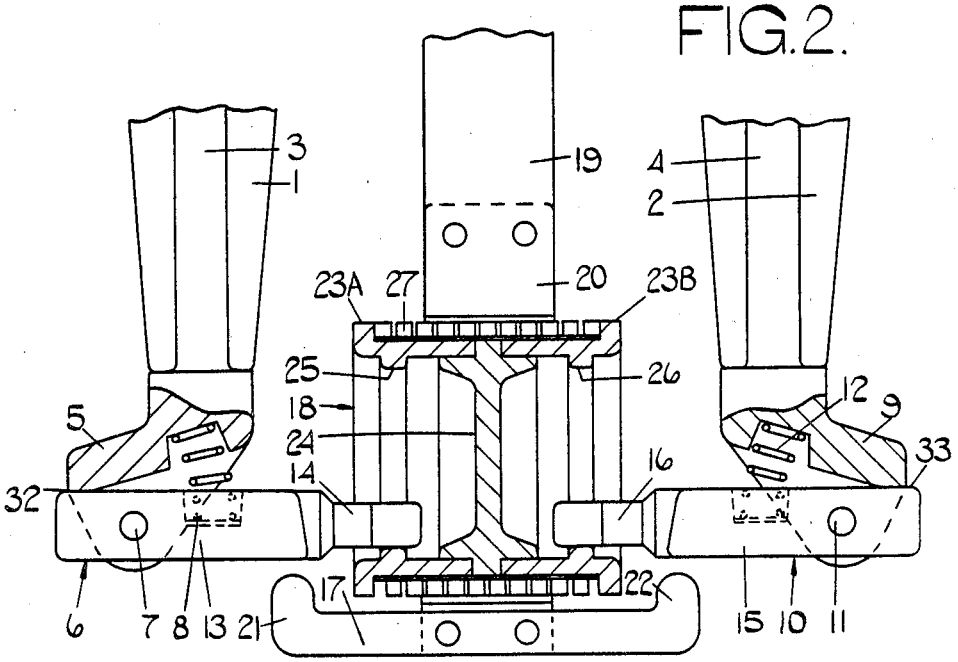
FIGS. 2 and 3 are similar views to FIG. 1, but showing the contacts respectively partially open and fully open.

In order to open the contacts of the circuit breaker, the shaft 19 is moved in the direction of the arrow 31 by an operating mechanism (not shown), the field coil assembly 18 and main contact bar 17 moving with the shaft since they are carried by it. As the shaft 19 moves in the direction of the arrow 31, the contact arms 6 and 10 pivot under the action of their respective springs 8 and 12 to follow the motion of the main contact bar 17. On further movement of the shaft 19, the end portions 14 and 16 of the contact arms come into contact with the arc runners 25 and 26 respectively, and the main body portions 13 and 15 disengage from the main contact bar 17. Ignoring any minor arcing at the main contact bar 17, the current path from conductor 3 to conductor 4 is now by way of the end portion 14 of contact arm 6, the arcing electrode 23A, the field coil 27, the arcing electrode 23B and the end portion 16 of contact arm 10. Pivotal movement of the arms 6 and 10 is limited by parts 32 and 33 of the mountings 5 and 9 which act as stops, and at their limits of movement the arms lie along a common axis. At this instant, the parts are disposed as shown in FIG. 2.

Figure 3:
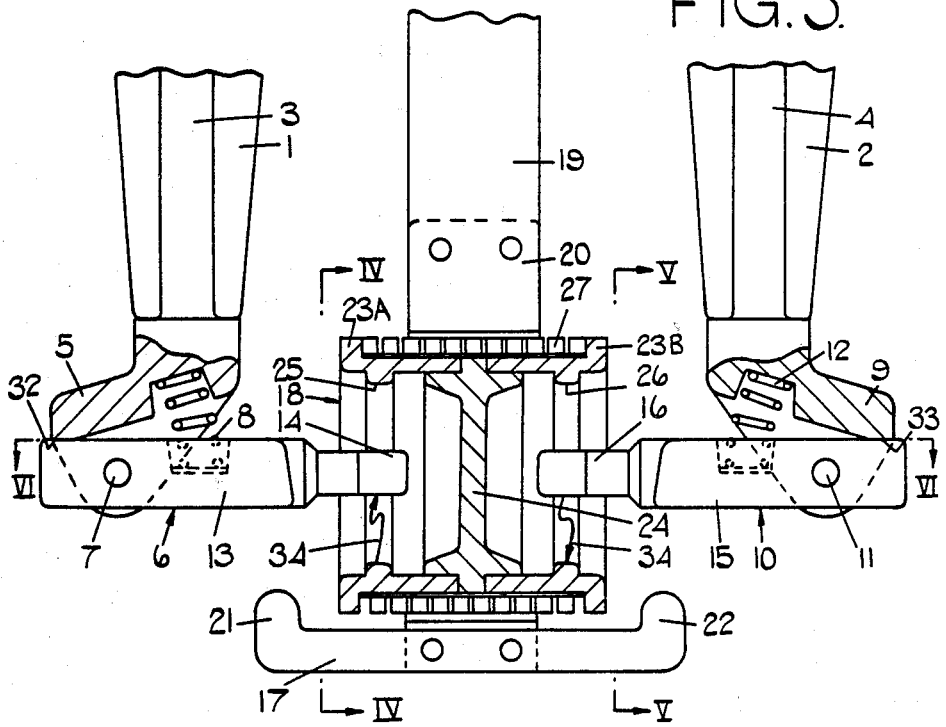
Figure 4:
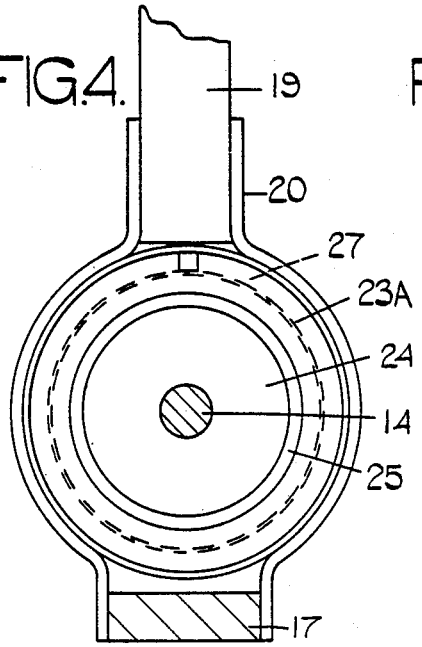
FIG. 4 is a section along the line IV—IV in FIG. 3.
Figure 5:
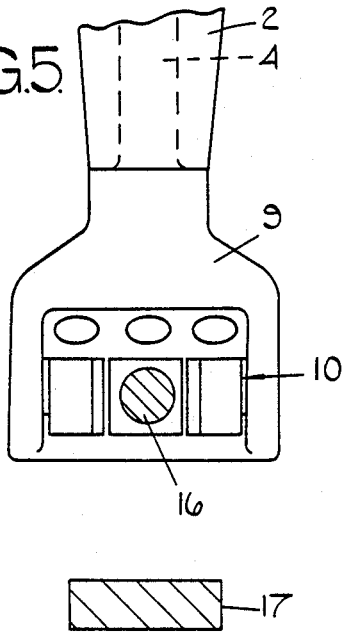
FIG. 5 is a section along the line V—V in FIG. 3.
Figure 6:
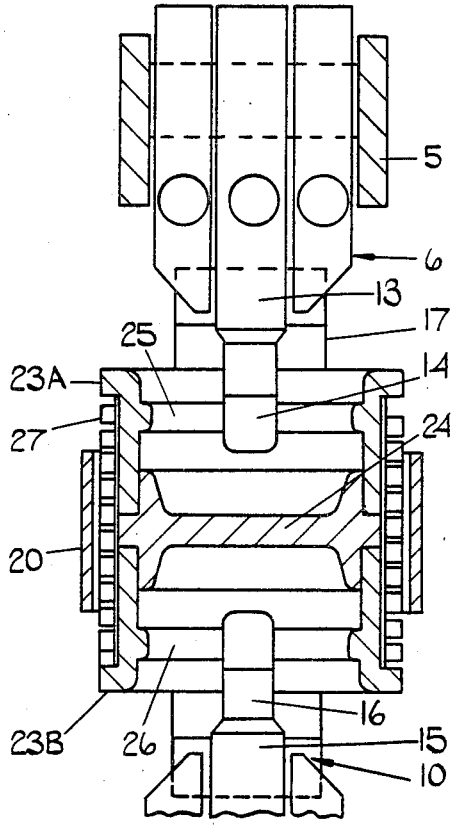
FIG. 6 is a section along the line VI—VI in FIG. 3.

On continued movement of the shaft 19, the arc runners 25 and 26 move out of contact with the contact arms 6 and 10, and an arc 34 is drawn radially between the end of each contact arm and the associated arc runner. Movement of the shaft 19 ceases when the axis of the field coil assembly 18 is in alignment with the common axis of the the contact arms, as shown in FIG. 3. The current path from conductor 3 to conductor 4 is now by way of contact arm 6, the arc between end portion 14 and arc runner 25, the field coil 27, the arc between arc runner 26 and end portion 16, and contact arm 10. The magnetic field generated by the current flowing in the coil 27 causes the arcs to rotate and become extinguished.

Figure 7:
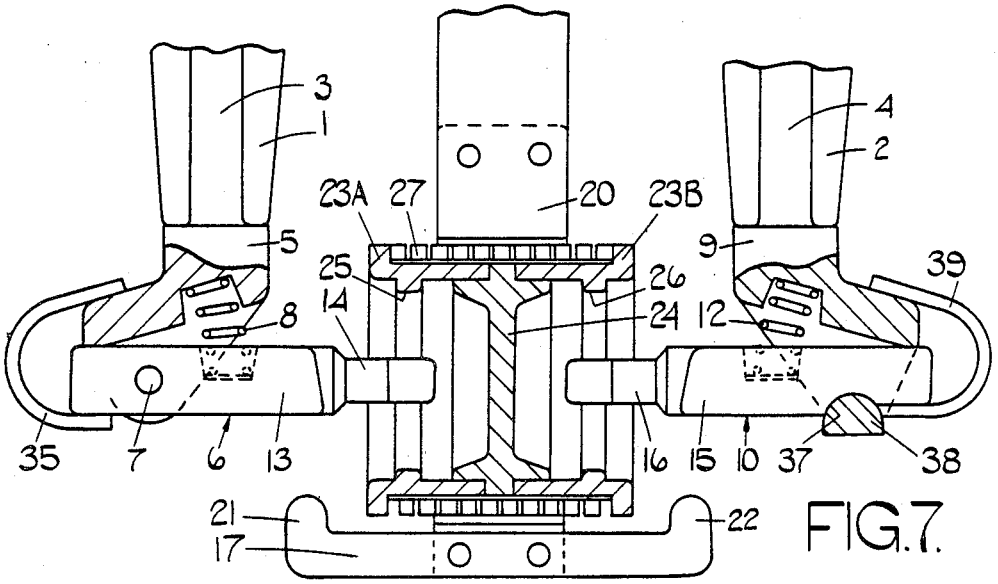
FIG. 7 is a similar view to FIG. 1 showing a modified form of electrical switchgear.

In the above construction, the connection between the contact arms and their mountings are shown as simple pin joints. In practice, however, a flexible conductive strap 35 can be added as shown in the left-hand part of FIG. 7 for the passage of most of the load current therethrough. In the right-hand part of FIG. 7, an alternative to the pin joint in the form of a stirrup-type mounting is shown. In this mounting, the main body portion of the contact arm has a recess 37 therein which locates over a projection 38 on the lower part of the mounting, enabling the contact arm to rock about the projection 38. A flexible conductive strap 39 connects the contact arm to the mounting for the passage of most of the load current therethrough.

Figure 8:
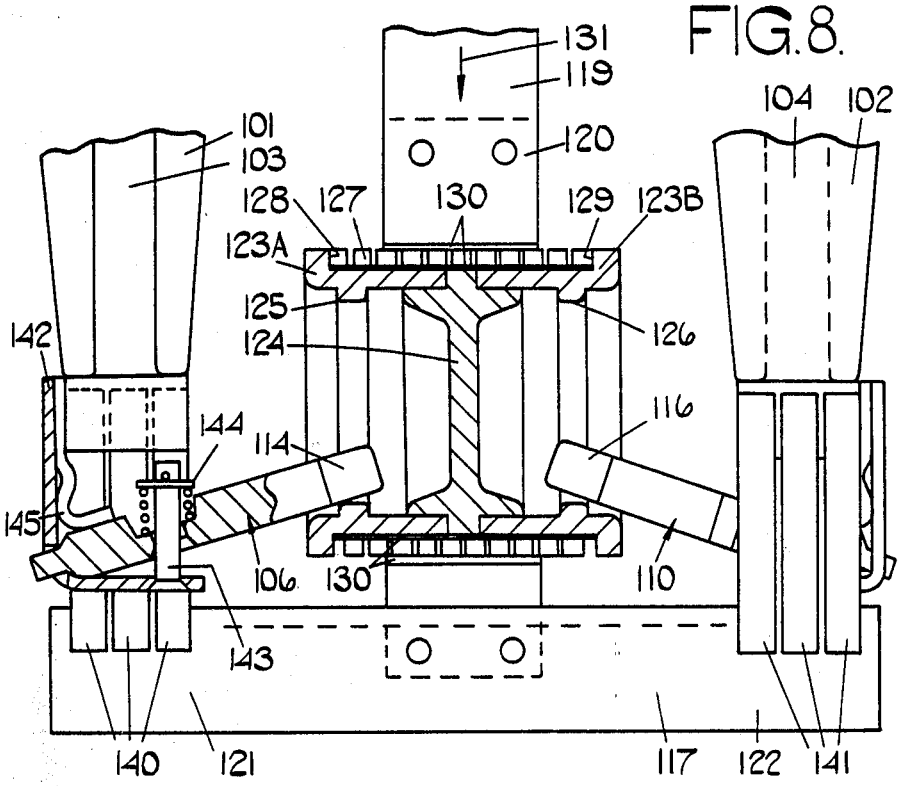
FIG. 8 is a schematic side view of a second embodiment of electrical switchgear according to the present invention, showing contacts of the switchgear in a closed position.

A second embodiment of a circuit breaker according to the present invention is shown in FIGS. 8 to 11, and is generally similar to the embodiment already described with reference to FIGS. 1 to 6. Accordingly, similar parts are denoted by the same reference numerals, but with 100 added. In this embodiment, however, the conductors 103 and 104 are connected to respective sets 140 and 141 of main contact fingers which engage the ends of the main contact bar 117 when the circuit breaker is in its closed position, as shown in FIG. 8. The contact arm 106 is mounted for angular movement by a respective yoke member 142 and a mounting pin 143 passing through a shaped recess in the contact arm, and a spring 144 provided about the pin 143 urges the contact arm towards the position shown in FIG. 10. A flexible conductive strap 145 connects the contact arm 106 to the conductor 103 for the passage of most of the load current therethrough. The contact arm 110 is similarly provided with a yoke member, mounting pin, spring and flexible strap.

Whereas in the construction of FIGS. 1 to 6 the contact arms are spaced from the respective arc runners when the circuit breaker is in its closed position, in this embodiment the end portions 114 and 116 of the contact arms 106 and 110 actually engage the arc runners 125 and 126 respectively in the contacts closed position. However, since the main contact bar 117 is in parallel with the field coil 127, little current passes through the coil 127 in the contacts closed position because it presents a path of higher impedance than the contact bar 117.

Figure 9:
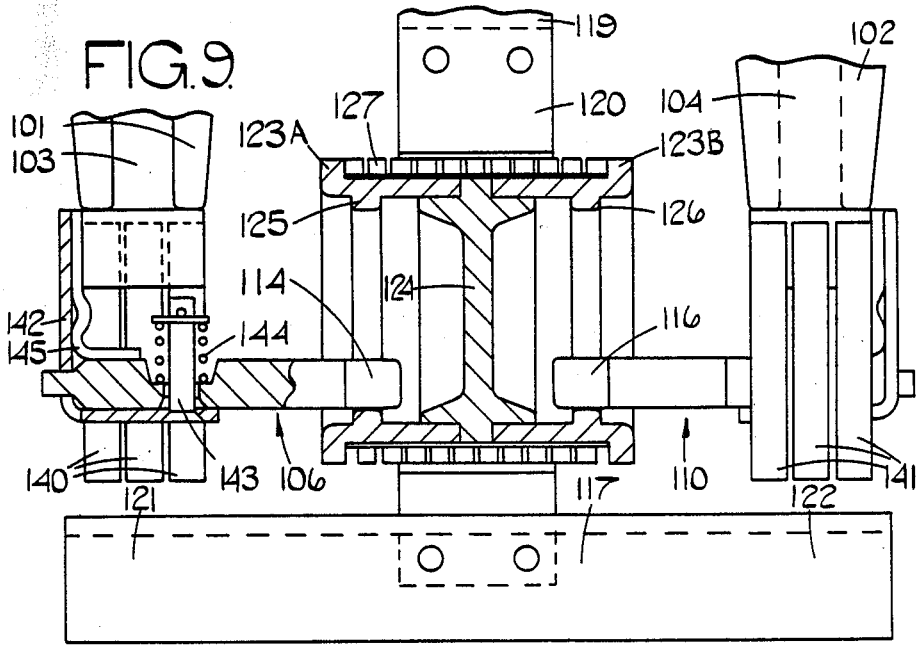

The circuit breaker is opened by moving the shaft 119 in the direction of arrow 131. After the ends of the contact bar 117 have disengaged from the contact fingers 140 and 141, the drawing and extinction of the arcs proceeds as described above with reference to FIGS. 1 to 3. FIGS. 8, 9 and 10 illustrate various stages during this operation, and correspond respectively to the stages shown in FIGS. 1, 2 and 3.

Figure 12:
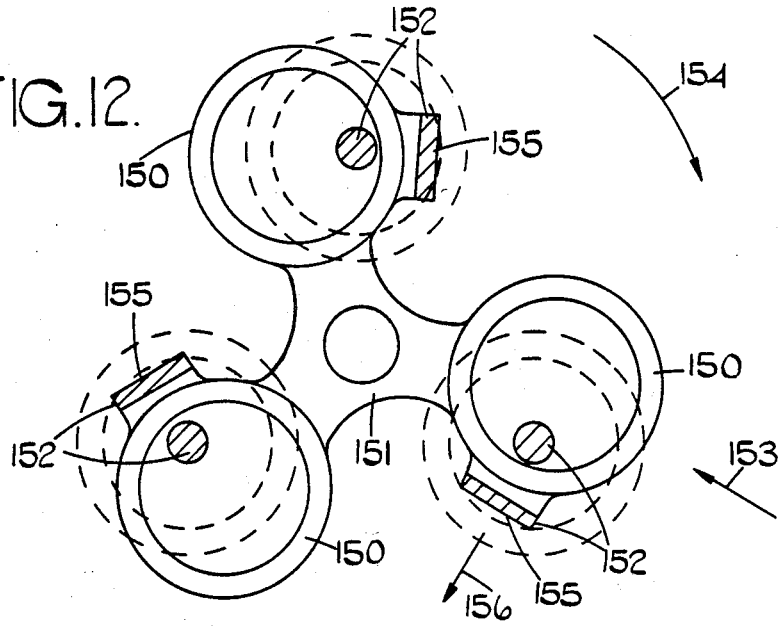
FIG. 12 is a schematic view of a third embodiment of electrical switchgear according to the present invention, suitable for three-phase operation.

FIG. 12 illustrates diagrammatically a three phase circuit breaker in which the rectilinear movement of the coil assembly of the circuit breaker of FIGS. 1 to 6 is replaced by an arcuate movement. Three coil assemblies 150 are carried on a rotatably mounted insulating spider 151 and each coil assembly is associated with a respective contact assembly 152 such that the view along the direction of the arrow 153 corresponds generally to FIG. 1. The spider 151 is rotated in the direction of arrow 154 to open the contacts, the contacts open position of the coil assemblies being shown in dotted lines and the contacts closed position in solid outline. Reference numeral 155 denotes the main contact bars, and arrow 156 shows the load direction of one of the contact springs.

Figure 13:
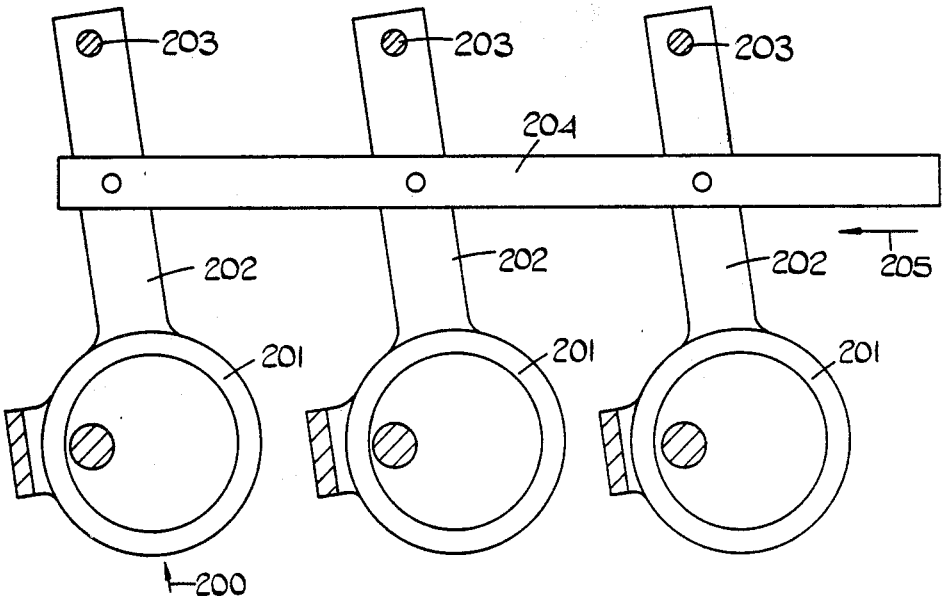
FIG. 13 is a schematic view of a fourth embodiment of electrical switchgear according to the present invention, also suitable for three-phase operation.

FIG. 13 illustrates diagrammatically another three phase circuit breaker in which a view along the arrow 200 corresponds generally to FIG. 1. In FIG. 13, coil assemblies 201 are carried on respective insulating links 202 pivotally mounted on fixed pivots 203. An operating link 204 pivotally connected to the insulating links 202 is movable in the direction of the arrow 205 to open the circuit breaker (the contacts open position of one coil assembly being shown in broken outline).

All the illustrated arrangements possess the advantage that during the opening of the contacts, current is commutated positively to energise the field coil so that further movement will draw the radial arcs in an excellent position for subsequent rotation and extinction. The main contact faces are kept well away from the arcing contacts so that contamination from the products of the rotating arc will be reduced. The arcing contacts need be large enough only to deal with the short duration of current interruption while the main contacts can be of heavier construction to carry the normal continuous rated current. As an alternative to the illustrated arrangements additional multiple main contact fingers can be used where the normal rated current is high.

Moreover, although the constructions described above are of the double-break type, they use only one field coil per double break while keeping low the danger of "tracking" across the shared structure, since there is no continuous solid insulating material between the contacts when the circuit breaker is open. The principal insulating surfaces are advantageously arranged between live parts and earth (as opposed to across the poles) and are kept well away from the direct arcing zone. A solid insulating barrier is provided between the two arcing zones positively to prevent the arc being transferred directly across the two contact arms. It is to be noted, however, that this insulation material has to have good "puncture" strength only and, in the vicinity of the arcs, does not need to have electrical strength over its surfaces within the arcing electrodes. The insulating barrier provides support for the pair of arcing electrodes, while separating them electrically to permit the flow of current through the field coil. The outer cylindrical surface of this barrier is therefore the only part which is stressed along its surface.

This surface is well protected from the effects of arcing and is subject only to the voltage drop across the coil. Contamination of the other surfaces will not significantly, if at all, affect the performance.

Although only a single phase is shown in the embodiments of FIGS. 1 to 11, it is to be understood that multiphase arrangements can be made by an appropriate replication of parts.

I claim:

1. Electrical switchgear comprising a contact set composed of a pair of first contact means, second contact means, and moving means operative to move said contact set between a closed position in which said second contact means is engaged with said pair of first contact means and an open position in which said second contact means is disengaged from said pair of first contact means, a field coil located between and common to said pair of first contact means, said common field coil having a pair of terminal connections and an axis, and a pair of arcing electrodes electrically connected to said terminal connections of said common field coil respectively, each of said pair of first contact means forming a respective arc to a respective one of said arcing electrodes when said moving means is operated to move said contact set from said closed position to said open position, a current flowing through said common field coil produced by said arcs creating a magnetic field which causes said arcs to rotate and become extinguished, said common field coil being electrically isolated from said first contact means in said open position of said contact set.

2. The electrical switchgear according to claim 1, wherein each of said first contact means engages said respective one of said arcing electrodes before and for some time after it disengages from said second contact means during movement of said contact set from said closed position to said open position.

3. The electrical switchgear as according to claim 2, wherein each of said first contact means is engaged with said respective one of said arcing electrodes when said contact set is in said closed position.

4. The electrical switchgear according to claim 2, wherein each of said first contact means is spaced from said respective one of said arcing electrodes when said contacts set is in said closed position and moves into engagement with said respective one of said arcing electrodes during initial movement of said contact set towards said open position.

5. The electrical switchgear according to claim 3 or 4, wherein each of said first contact means comprises a contact arm which is angularly movable about an axis transverse to said axis of said common field coil, said contact arm having a body portion for engagement with said second contact means and an end portion for engagement with said respective one of said arcing electrodes.

6. The electrical switchgear according to claim 3 or 4, wherein each of said first contact means comprises contact fingers for engagement with said second contact means and a contact arm for engagement with said respective one of said arcing electrodes, said contact arm being angularly movable about an axis transverse to said axis of said common field coil.

7. The electrical switchgear according to claim 1, wherein each of said pair of arcing electrodes defines in section a simple closed geometric figure.

8. The electrical switchgear according to claim 7, wherein said pair of arcing electrodes comprise respectively a pair of generally cylindrical members separated by an electrically insulating barrier.

9. The electrical switchgear according to claim 8, wherein said pair of generally cylindrical members are circular in cross-section.

10. The electrical switchgear according to claim 1, wherein said common field coil is helically wound about said pair of arcing electrodes.

11. The electrical switchgear according to claim 1, wherein each of said first contact means includes a contact arm which is angularly movable about an axis transverse said axis of said common field coil.

12. The electrical switchgear according to claim 11, further comprising a pair of tubular arcing electrodes electrically connected to said pair of ends of said common field coil respectively, each of said first contact means having an end portion which extends into a respective one of said tubular arcing electrodes and which forms said respective arc thereto when said moving means is operated to move said contact set from said closed position to said open position.

13. The electrical switchgear according to claim 11, wherein said contact arm of each of said contact means has a spring-loaded pivotal or rocking mounting.

14. The electrical switchgear according to claim 11, wherein said contact arm of each said first contact means has an end portion which lies along said axis of said common field coil when said contact set is in said open position.

15. The electrical switchgear according to claim 1, further comprising a common support mounting said common field coil and said second contact means, said common support being movable by said moving means relative to said pair of first contact means in a direction transverse to said axis of said common field coil.

16. The electrical switchgear according to claim 15, comprising a plurality of contact sets each having a respective pair of first contact means, respective second contact means and a respective associated common field coil, said second contact means and said common field coils all being movable in unison relative to said pairs of first contact means.

17. The electrical switchgear according to claim 16, further comprising a common support mounting said second contact means and said common field coils, said common support being angularly movable about a rotation axis, and said pairs of first contact means of said contact sets being angularly spaced apart around said rotation axis.

18. The electrical switchgear according to claim 16, further comprising a plurality of supports each of which mounts said second contact means of a respective one of said contact sets and said associated common field coil, each said supports being angularly movable about a respective fixed rotation axis, and wherein an operating link interconnects said supports and is movable to effect angular movement of said supports about said rotation axes in unison.

19. The electrical switchgear according to claim 1, in the form of a circuit breaker.

20. The electrical switchgear according to claim 1, wherein sulphur hexafluoride is employed as an insulating gas.

* * * * *